US008011814B2

(12) United States Patent
Lai et al.

(10) Patent No.: US 8,011,814 B2
(45) Date of Patent: Sep. 6, 2011

(54) ILLUMINATING DEVICE

(75) Inventors: Chih-Ming Lai, Miao-Li Hsien (TW); Wen-Jang Jiang, Miao-Li Hsien (TW)

(73) Assignee: Foxsemicon Integrated Technology, Inc., Chu-Nan, Miao-Li Hsien (TW)

( * ) Notice: Subject to any disclaimer, the term of this patent is extended or adjusted under 35 U.S.C. 154(b) by 458 days.

(21) Appl. No.: 12/178,821

(22) Filed: Jul. 24, 2008

(65) Prior Publication Data

US 2009/0154175 A1 Jun. 18, 2009

(51) Int. Cl.
*F21V 29/00* (2006.01)

(52) U.S. Cl. ..... 362/373; 362/345

(58) Field of Classification Search ..... 362/373, 362/547, 218, 345; 315/360, 112, 294, 297; 700/299, 300
See application file for complete search history.

(56) References Cited

FOREIGN PATENT DOCUMENTS

| | | |
|---|---|---|
| CN | 1957296 A | 5/2007 |
| TW | 260352 | 10/1995 |
| TW | I252900 | 4/2006 |

*Primary Examiner* — Sharon Payne
(74) *Attorney, Agent, or Firm* — Altis Law Group, Inc.

(57) ABSTRACT

An illuminating device includes a circuit board, a light source, and a thermoelectric cooler. The circuit board has a first surface and a second surface at an opposite side of the circuit board to the first surface. The light source is electrically mounted on the first surface of the circuit board. The thermoelectric cooler is attached on the second surface of the circuit board.

1 Claim, 2 Drawing Sheets

ILLUMINATING DEVICE

TECHNICAL FIELD

The present invention relates to a illuminating device.

DISCUSSION OF RELATED ART

At present, cold cathode fluorescent lamps and light-emitting diodes (LEDs) are popularly used as illuminating devices.

Generally, heat produced by the illuminating device can be transferred via air convection and dissipated into the external environment. However, the air has a relatively small thermal conductivity coefficient, and, as such, heat dissipation is slow. Eventually, the heat accumulated around the illuminating device will influence the light intensity of the LED, thereby reducing the operation life thereof.

Therefore, what is needed, is an illuminating device having high heat dissipation efficiency.

SUMMARY

An illuminating device includes a circuit board, a light source, and a thermoelectric cooler. The circuit board has a first surface and a second surface at an opposite side of the circuit board to the first surface. The light source is electrically mounted on the first surface of the circuit board. The thermoelectric cooler is attached on the second surface of the circuit board.

BRIEF DESCRIPTION OF THE DRAWINGS

Many aspects of the present illuminating device can be better understood with reference to the following drawings. The components in the drawings are not necessarily drawn to scale, the emphasis instead being placed upon clearly illustrating the principles of the present illuminating device. Moreover, in the drawings, like reference numerals designate corresponding parts throughout the several views.

DETAILED DESCRIPTION OF PREFERRED EMBODIMENTS

Figure 1:
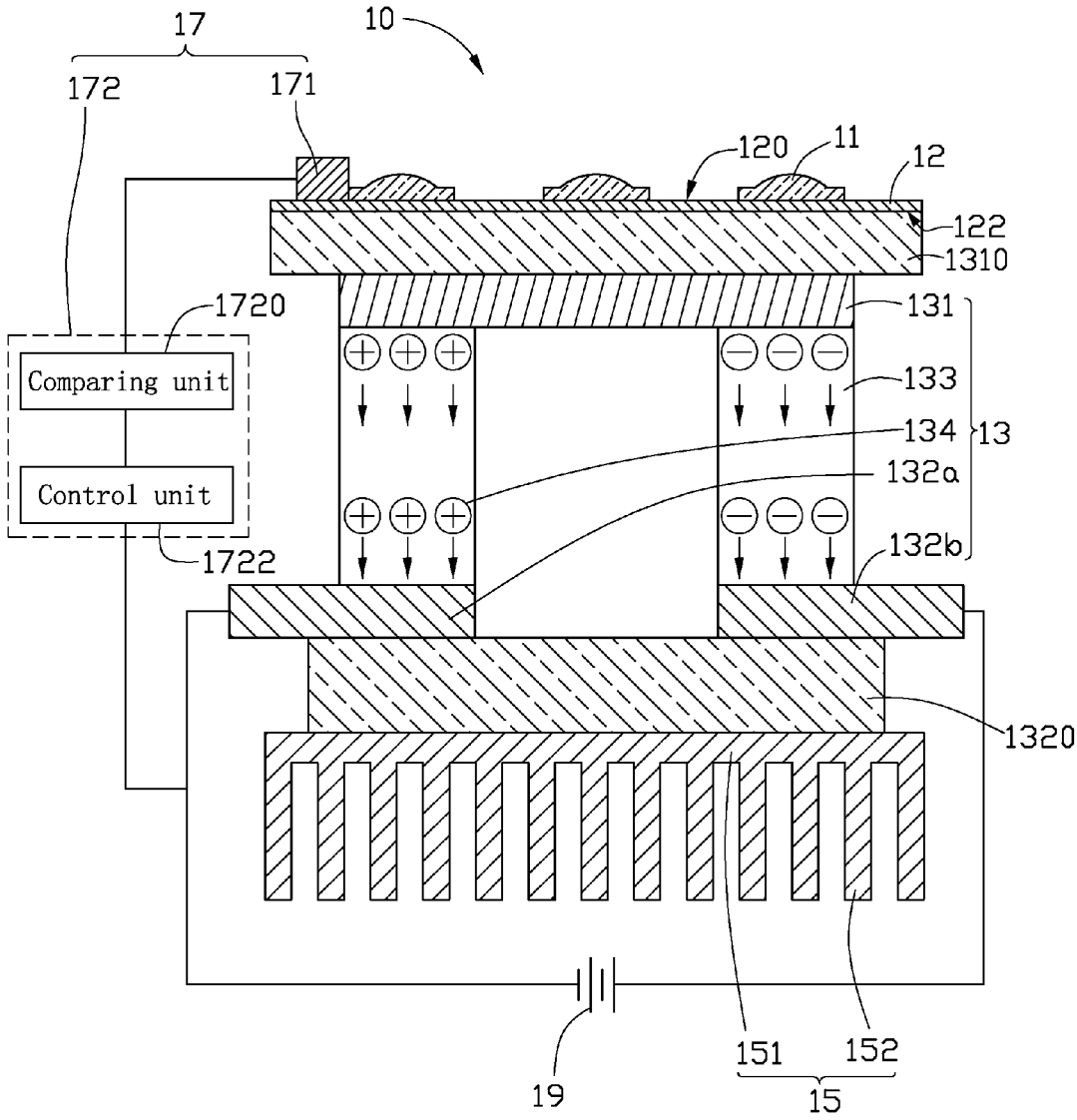
FIG. 1 is a schematic view of an illuminating device in accordance with an exemplary embodiment.

Referring to FIG. 1, an illuminating device 10 in accordance with an exemplary embodiment includes at least one light source 11, a circuit board 12, and a thermoelectric cooler (TEC) 13.

In the present embodiment, the at least one light source 11 consists a plurality of LEDs. The plurality of LEDs is selected from the group consisting of white LED, green LED, red LED, and blue LED.

The circuit board 12 includes a first surface 120 and a second surface 122 facing away from the first surface 120. The plurality of light sources 11 is electrically attached to the first surface 120 of the circuit board 12. In the present embodiment, the circuit board 12 is a ceramic substrate printed board. In alternative embodiments, the circuit board 12 can be a glass fiber board.

In the present embodiment, the TEC 13 includes a condensation section 131, a first evaporation section 132*a* and a second evaporation section 132*b*. The first evaporation section 132*a* and the second evaporation section 132*b* are opposite to the condensation section 131. A p-type semiconductor 134 is disposed between the condensation section 131 and the first evaporation section 132*a*. An n-type semiconductor 133 is disposed between the condensation section 131 and the second evaporation section 132*b*. The condensation section 131 of the TEC 13 is adjacent to the second surface 122 of the circuit board 12.

In operation, the TEC 13 is connected to a DC voltage 19. In detail, the n-type semiconductor 133 is connected to the positive pole, and the p-type semiconductor 134 is connected to the negative pole. The TEC 13 is a solid-state active heat pump which transfers heat from the condensation section 131 to the evaporation sections (132*a*, 132*b*), by consumption of electrical energy. The effectiveness of the pump for transferring the heat away from the condensation section 131 is totally dependent upon the amount of current provided and the efficiency of the evaporation sections (132*a*, 132*b*).

In order to dissipate heat more efficiently, the illuminating device 10 can further comprise a heat sink 15 attached to the first evaporation section 132*a* and the second evaporation section 132*b*. The heat sink 15 includes a substrate 151 and fins 152 formed on the substrate 151. The substrate 151 is formed on the first evaporation section 132*a* and the second evaporation section 132*b*.

The illuminating device can further include a first ceramic board 1310 and a second ceramic board 1320. The first ceramic board 1310 is formed on the second surface 122 of the circuit board 12, and the condensation section 131 is formed on the first ceramic board 1310, i.e., the first ceramic board 1310 is sandwiched between the circuit board 12 and the condensation section 131. The second ceramic board 1320 is formed on the first evaporation section 132*a* and the second evaporation section 132*b*. That is, the TEC 13 is sandwiched between the first ceramic board 1310 and the second ceramic board 1320. Since the ceramic boards 1310 and 1320 have good thermal conductivity and insulating property, the heat generated by the LEDs 11 can be well conducted to the TEC 13, meanwhile, the circuit board 12 and the TEC 13, the TEC 13 and the heat sink 15, are insulated from each other separately.

Referring to FIG. 1 again, a temperature control unit 17 is applied to the illuminating device 10 for adjusting the temperature thereof. The temperature control unit 17 includes a temperature sensor 171 and a control circuit 172. The temperature sensor 171 is attached to the circuit board 12 near the LEDs 11. The temperature sensor 171 can be a thermometer, a thermocouple, a temperature sensitive resistor (thermistor or resistance temperature detector), a bi-metal thermometer, a thermostat, etc. The control circuit 172 is electrically connected with the temperature sensor 171 and the DC voltage 19 connected to the TEC 13.

Figure 2:
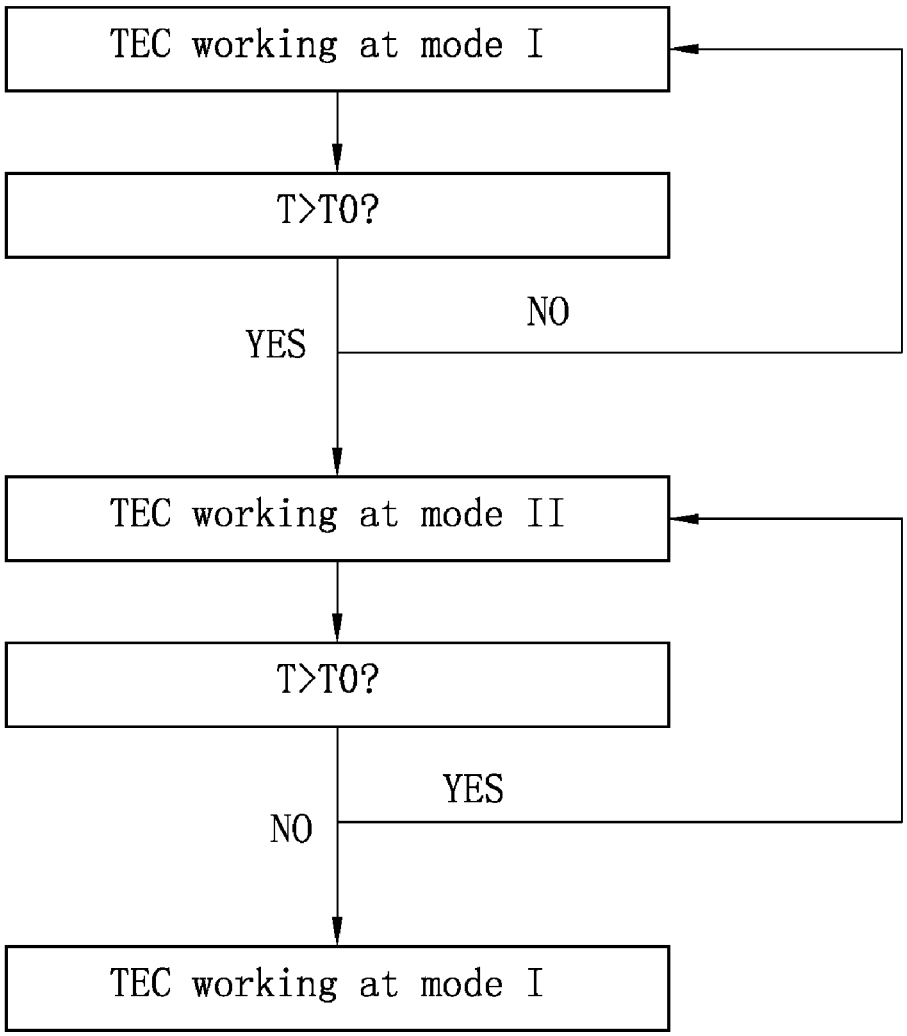
FIG. 2 is a flow chart of a method for adjusting the temperature of the illuminating device in accordance with the exemplary embodiment.

The control circuit 172 includes a comparing unit 1720 and a control unit 1722. The comparing unit 1720 is utilized to compare the heat generated by the LEDs 11 with a predetermined temperature T. The value of the predetermined temperature T is stored in the comparing unit 1720. The TEC 13 has two working mode, mode I (lower temperature) and mode II (higher temperature). Referring to FIG. 2, when the comparing unit 1720 determines that the temperature T of the LEDs 13 detected by the temperature sensor 171 is lower than the predetermined temperature T0, the TEC 13 remains at mode I. When the comparing unit 1720 determines that the temperature T of the LEDs 13 is higher than the predetermined temperature T0, the comparing unit 1720 generates a control signal to the control unit 1722. The control unit 1722 then adjusts (increases, for example) the voltage of the DC voltage 19 or the current provided to the TEC 13 to switch the TEC 13 to work at mode II. The heat generated by the LEDs 11 can be transferred away more effectively when the TEC 13 works at mode II. When the comparing unit 1720 determines that the temperature T of the circuit board 12 is lower than the predetermined temperature T0 again, the comparing unit 1720 generates a control signal to the control unit 1722. The control unit 1722 then adjusts the voltage of the DC voltage 19 to switch the TEC 13 to work at mode I. The predetermined temperature T0 can be set according to actual requirements. It is to be understood that, additional temperature sensors 171 can be attached to the circuit board 12 to increase the work efficiency.

In summary, the TEC 13 can work at mode I and mode II in accordance with the thermal radiation emitted from the LEDs.

While the present invention has been described as having preferred or exemplary embodiments, the embodiments can be further modified within the spirit and scope of this disclosure. This application is therefore intended to cover any variations, uses, or adaptations of the embodiments using the general principles of the invention as claimed. Further, this application is intended to cover such departures from the present disclosure as come within known or customary practice in the art to which the invention pertains and which fall within the limits of the appended claims or equivalents thereof.

What is claimed is:

1. An illuminating device, comprising:

a circuit board having a first surface and a second surface at an opposite side of the circuit board to the first surface;

a light source electrically mounted on the first surface of the circuit board;

a thermoelectric cooler attached on the second surface of the circuit board;

a heat sink being attached on an opposite side of the thermoelectric cooler to the circuit board;

a first ceramic board sandwiched between the circuit board and the thermoelectric cooler, and a second ceramic board sandwiched between the thermoelectric cooler and the heat sink;

a temperature sensor attached to the circuit board adjacent to the light source for detecting heat radiation emitted therefrom; and a control circuit being electrically connected with the temperature sensor and the thermoelectric cooler;

wherein the thermoelectric cooler selectively operates in a first working mode or a second working mode, the thermoelectric cooler which operates in the second working mode is capable of absorbing more heat than that operates in the first working mode; and wherein the control circuit comprises a comparing unit and a control unit, and a predetermined reference value of a temperature stored in the comparing unit, the comparing unit is configured for comparing a value of temperature detected by the temperature sensor with the predetermined reference value and generating a control signal to the control unit, the control unit is configured for supplying a current to the thermoelectric cooler based on the control signal so as to change the working mode of the thermoelectric cooler between the first working mode and the second working mode.

* * * * *